United States Patent [19]

Peltier et al.

[11] Patent Number: 4,500,591

[45] Date of Patent: Feb. 19, 1985

[54] FOAM RUBBER BACKINGS FOR COMPOSITE MATERIALS HAVING GLASS FIBER SUBSTRATES COATED WITH PVC

[75] Inventors: Gerard Peltier, Schiltigheim; Michel Longuet, Haguenau, both of France; Charles A. Midgley, Sarnia, Canada

[73] Assignee: Polysar International S.A., Fribourg, Switzerland

[21] Appl. No.: 506,318

[22] Filed: Jun. 21, 1983

[30] Foreign Application Priority Data

Jun. 21, 1982 [FR] France ..... 82 10802

[51] Int. Cl.[3] ..... B32B 7/00

[52] U.S. Cl. ..... 428/251; 264/45.8; 264/46.4; 264/50; 428/268; 428/285; 428/317.3; 428/323

[58] Field of Search ..... 428/246, 250, 251, 268, 428/285, 323, 317.3; 264/45.8, 46.4, 50

[56] References Cited

U.S. PATENT DOCUMENTS

| | | | |
|---|---|---|---|
| 3,336,180 | 8/1967 | Werner | 428/251 |
| 3,360,422 | 12/1967 | Desch | 428/251 |
| 3,553,047 | 1/1971 | Godden | 264/46.4 |
| 3,649,433 | 3/1972 | Drout | 428/294 |
| 3,813,462 | 5/1974 | Roberts | 264/45.8 |
| 4,259,384 | 3/1981 | Vergo et al. | 264/50 |
| 4,390,585 | 6/1983 | Holden | 428/251 |

FOREIGN PATENT DOCUMENTS

| | | | |
|---|---|---|---|
| 867746 | 5/1961 | United Kingdom | 428/251 |

*Primary Examiner*—James J. Bell

*Attorney, Agent, or Firm*—Stevens, Davis, Miller & Mosher

[57] ABSTRACT

Composite materials having glass fiber substrates and attached foam backings are useful in surface covering applications especially as resilient floor coverings. The glass fiber substrates are usually coated with a plastisol of polyvinyl chloride. Conventional foam rubber backings made from high solids SBR latex have poor adhesion to such coated substrates. However this problem may be overcome by using foam rubber backings made from a blend of SBR and NBR latices, which backings have excellent adhesion to these coated substrates.

14 Claims, No Drawings

FOAM RUBBER BACKINGS FOR COMPOSITE MATERIALS HAVING GLASS FIBER SUBSTRATES COATED WITH PVC

FIELD OF THE INVENTION

Composite surface covering material such as resilient vinyl flooring has traditionally been manufactured with an asbestos substrate. Due to environmental and health concerns, there has been a shift away from asbestos substrates to woven or non-woven substrates manufactured from glass fibers. Glass fiber substrates have an internal binder and are often coated with a plastisol of a copolymer or homopolymer of vinyl chloride. Such coatings are sometimes referred to as encapsulated coatings.

BACKGROUND OF THE INVENTION

There is a market demand for such surface coverings which have an attached foam structure. This may be provided by a foamed backing applied to the coated glass fiber substrate. Such a foamed backing may be made from polyvinyl chloride, polyurethane, or a synthetic rubber latex. When the substrate is coated with a plastisol of a copolymer or homopolymer of vinyl chloride, there is a good adhesion between the coated substrate and polyvinyl chloride or polyurethane foams. Unfortunately, there is poor adhesion between the coated substrate and foams manufactured from conventional synthetic high solids styrene-butadiene rubber latices. However, from the viewpoint of cost, such synthetic latex foam rubber offers an advantage over polyvinyl chloride and polyurethane foams.

Accordingly there is a need to develop an improved synthetic rubber latex which when foamed will have good adhesion to glass fiber substrates coated with a plastisol of a copolymer or homopolymer of vinyl chloride. There is also a need for a method of manufacturing an improved composite material comprising a woven or non-woven glass fiber substrate coated with a plastisol of a copolymer or homopolymer of vinyl chloride to which is attached a synthetic latex foam rubber. The present invention seeks to meet these needs.

SUMMARY OF THE INVENTION

Accordingly the present invention provides a composite material comprising a woven or a non-woven glass fiber substrate which is coated with a plastisol of a copolymer or homopolymer of vinyl chloride to which plastisol coating is attached a layer of synthetic foam rubber formed from a latex having a bulk polymer composition comprising (a) from about 0 to about 30 percent by weight of a vinyl or vinylidene monoaromatic monomer which may be unsubstituted or substituted by a $C_{1-4}$ aliphatic radical or a bromine or chlorine radical; (b) from about 60 to about 85 percent by weight of a $C_{4-6}$ aliphatic conjugated diene monomer; and (c) from about 3 to about 40 percent by weight of a polar monomer selected from the group consisting of $C_{2-9}$ ethylenically unsaturated amide, aldehyde, carboxylic acid, and nitrile monomers, and $C_{1-6}$ esters of said carboxylic acid monomers.

The present invention also provides a method of manufacturing a composite material comprising a woven or a non-woven glass fiber substrate which is coated with a plastisol of a copolymer or homopolymer of vinyl chloride to which plastisol coating is attached a layer of synthetic foam rubber, the method comprising applying a layer of foamed synthetic rubber latex to the plastisol coating and then drying the foamed latex. the improvement comprising using a latex having a polymer solids content of at least about 60 percent by weight, the latex having a bulk polymer composition comprising (a) from about 0 to about 30 percent by weight of a vinyl or vinylidene monoaromatic monomer which may be unsubstituted or substituted by a $C_{1-4}$ aliphatic radical or a bromine or chlorine radical; (b) from about 60 to about 85 percent by weight of a $C_{4-6}$ aliphatic conjugated diene monomer; and (c) from about 3 to about 40 percent by weight of a polar monomer selected from the group consisting of $C_{2-9}$ ethylenically unsaturated amide, aldehyde, carboxylic acid, and nitrile monomers, and $C_{1-6}$ esters of said carboxylic acid monomers.

PREFERRED EMBODIMENTS

The composite material of the present invention may additionally comprise one or more additional layers attached to the side of the substrate remote from the layer of synthetic foam rubber which additional layers may be of any convenient composition. For example, in flooring applications, the composite material usually has two such additional layers. The outermost additional layer usually is a thin wear surface of plasticized polyvinyl chloride (PVC) while the additional layer which is attached to the substrate is usually a PVC chemical foam which may contain a filler such as calcium carbonate.

The substrates used in the present invention are woven or non-woven glass fiber substrates which are internally bonded with an adhesive. The adhesive may be for example a urea-formaldehyde or melamine-formaldehyde resin, a polyvinyl alcohol, or an acrylic latex. The substrate is coated with a plastisol of a copolymer or homopolymer of vinyl chloride which may optionally contain a filler such as calcium carbonate. A PVC plastisol is the most commonly used coating. Usually, 50 to 60 g of glass fiber are used per square meter of substrate. The PVC plastisol coating is usually applied to the substrate using a coating weight of about 450–700 g/m$^2$. The plastisol usually contains about 70 parts by weight of a plasticizer and about 50 to 150 parts by weight of a filler such as calcium carbonate per 100 parts by weight of PVC. After application, the coating is usually pre-gelled on a heating drum at 120° to 160° C. to get a very smooth surface. While there may be some impregnation of the fibrous substrate by the coating, most of the PVC remains on the surface of the substrate and it is to this coating that the synthetic latex foam rubber is subsequently attached.

Synthetic rubber latices having satisfactory adhesion to such coated substrates should have a polymer solids content of at least about 60 percent by weight and a bulk polymer composition comprising (a) from about 0 to about 30 percent by weight of vinyl or vinylidene monoaromatic monomer which may be unsubstituted or substituted by a $C_{1-4}$ aliphatic radical or a bromine or chlorine radical; (b) from about 60 to about 85 percent by weight of a $C_{4-6}$ aliphatic conjugated diene monomer; and (c) from about 3 to about 40 percent by weight of said polar monomer.

Suitable vinyl or vinylidene monoaromatic monomers include styrene which is unsubstituted or substituted by a $C_{1-4}$ alkyl radical or a chlorine or bromine radical. Useful such monomers include styrene, chlorostyrene, bromostyrene, α-methyl styrene, α-ethyl styrene, and para methyl styrene. Styrene is the preferred monomer.

The conjugated diene monomer may be any suitable copolymerizable $C_{4-6}$ conjugated diene. Suitable dienes include 1,3 butadiene, and isoprene. These are preferred due to cost and availability. Butadiene is the preferred monomer.

The polar monomer may be any copolymerizable $C_{2-9}$ ethylenically unsaturated amide, aldehyde, carboxylic acid, or nitrile monomer, or esters of said carboxylic acid monomer. Suitable amide monomers include acrylamide, methacrylamide and N-methyolacrylamide. Suitable aldehyde monomers include acrolein, methacrolein and cinnamaldehyde. Suitable carboxylic acid monomers include acrylic acid, methacrylic acid, cinnamic acid, crotonic acid, itaconic acid, maleic acid, fumaric acid, and mixtures of these acids. Suitable ester monomers include methyl acrylate and methacrylate. A nitrile monomer is preferred and suitable nitrile monomers include acrylonitrile and methacrylonitrile. Acrylonitrile is the preferred monomer.

Preferably the latex has a bulk polymer composition comprising: (a) from about 15 to about 25 weight percent of styrene; (b) from about 65 to about 75 weight percent of butadiene; and (c) from about 5 to about 20 weight percent of acrylonitrile.

Most preferably, the latex has a bulk polymer composition comprising: (a) about 18 weight percent of styrene; (b) about 68 weight percent of butadiene; and (c) about 14 weight percent of acrylonitrile.

Suitable latices may be prepared by blending a latex of a polymer comprising a vinyl or vinylidene monoaromatic monomer and a conjugated diolefin monomer with a latex of a polymer comprising a conjugated diolefin monomer and an ethylenically unsaturated nitrile monomer. Commerically available styrene-butadiene rubber (SBR) latices and acrylonitrile-butadiene rubber (NBR) latices may be blended to produce suitable latices. The ratio in which the starting latices are to be blended will depend upon the composition of the polymer in each latex and the solids content of each latex. The resulting blended latex should have a polymeric solids content of at least about 60 percent by weight. It is preferred to have a higher solids content of about 65 percent by weight.

A preferred latex blend comprises a blend of a SBR latex having about 65 percent solids and a styrene:butadiene weight ratio of from about 25:75 to about 35:65 with a NBR latex having about 56 percent solids and an acrylonitrile:butadiene weight ratio of from about 30:70 to about 40:60, the ratio of SBR latex:NBR latex being from about 80:20 to about 50:50.

It is also possible to prepare a blended latex which may contain less than 60 weight percent polymeric solids. The resulting latex may then be concentrated using conventional techniques.

When preparing a blended latex care should be taken to determine that the latices to be blended are compatible. This may be determined by mixing small quantities of the latices and observing if there is any adverse result such as coagulation. Trace ingredients in each latex, such as surfactant, electrolyte, and metal ions may affect the compatibility of latices.

The latex to be applied to the coated substrate may be compounded and foamed in a conventional manner. The latex may be compounded with a filler to provide up to about 150 parts by weight filler per 100 parts by weight of polymer solids in the latex. Preferably, the filler is used in amounts not exceeding about 80 parts by weight of filler per 100 parts by weight of polymer solids. The filler may be any conventional filler such as aluminum trihydrate, clay, baryte, talc, mica, or calcium carbonate.

To permit the formation of a foamed structure, a surfactant is added to the latex. The surfactant may be a soap or a synthetic emulsifier. The soap may be a fatty acid or a rosin type. One useful soap is an alkali or alkaline metal salt of oleic acid, such as potassium oleate. The soap may be added in amounts usually not exceeding about 5 parts by weight per 100 parts by weight of polymer solids.

The latex compound contains other ingredients as required in normal processing such as a cure paste, antioxidants and, where required, processing oils. The cure paste is a blend of curing agents and cure accelerators so that upon drying, the rubbery polymer in the latex will crosslink. Cure pastes and their methods of use are well known in the art. Antioxidants useful in the foam latex art are compounded with the latex to reduce the effect of heat and light on the foam. Such antioxidants and their levels of use are well known in the art.

Depending upon the process used, the latex compound may be applied to the coated substrate using a gel or no gel processes. If a gel process is used, a small amount of gelling agent or system is incorporated into the compound. Usually the amount of gelling agent is from about 3 to about 7 percent by weight on a wet basis of the latex compound. The gelling agent may be added to the compound as a solution or a dispersion depending upon the gelling agent or system used. The gel process is well known to the art. It is described for example in Chapter 5 of "Latex Foam Rubber" by E. W. Madge published by John Wiley and Sons.

Sodium silicofluoride is a suitable gelling agent and a mixture of ammonia and ammonium acetate is a suitable gelling system. In the gel method gelling agent is added to the compound immediately prior to foaming. The compound then passes through a foaming mechanism. The foamed compound is then applied to the substrate by conventional coating means such as a doctor roller or blade and dried. Typically, the foam is initially gelled under an infrared heater to provide a foam with a smooth surface or skin and then it is dried in a hot air circulating oven. While oven conditions will vary from plant to plant, typical drying times are about 7 to 10 minutes at 130° to 180° C. The actual process of applying a foamed latex compound to a substrate and subsequently drying the compound is well known in the art.

Similar procedures are used in a no-gel system except that the gelling agent or gelling system is omitted. The foam may also be embossed by any of the processes well known to the art.

The following examples serve to illustrate the present invention without limiting the scope thereof.

Three samples of a typical commercially available vinyl flooring composite were each attached to a different latex foam rubber backing. The vinyl flooring composite comprised two upper layers and a substrate coated on its underside with a PVC plastisol. The uppermost layer was a plasticized PVC wear layer. The second layer was a PVC chemical foam containing a calcium carbonate filler. The substrate was a glass fiber web internally bound with a urea-formaldehyde resin adhesive and the substrate was coated with a PVC plastisol containing a calcium carbonate filler.

Two latexes were used as starting materials to prepare the foam rubber backings. The first was a SBR latex having about 65 percent by weight polymer solids and a styrene to butadiene weight ratio of about 30:70. The second was a NBR latex having about 56 percent by weight polymer solids and a butadiene to acrylonitrile weight ratio of about 66:34. The SBR latex was used alone in comparative Example 1 while two blends of differing weight ratios of the SBR and NBR latices were made to illustrate the present invention in Examples 2 and 3 as shown below. Values are in percent by weight.

| EXAMPLE | LATEX | SOLIDS CONTENT | STYRENE/ BUTADIENE/ ACRYLONITRILE |
|---|---|---|---|
| 1 | 100 SBR | 65 | 30/70/0 |
| 2 | 80 SBR/20 NBR | 63 | 24/69/7 |
| 3 | 60 SBR/40 NBR | 61 | 18/68/14 |

Each latex was then compounded as follows:

| Component | Parts dry weight |
|---|---|
| Latex | 100.0 |
| Soap | 3.5 |
| Cure paste (inc. zinc oxide) | 8.0 |
| Wax emulsion | 3.0 |
| Silicone Oil Emulsion | 0.1 |
| Filler | 80.0 |

The resulting compounds were, where required, thickened with methyl cellulose or ammonium polyacrylate to obtain a Brookfield viscosity of 5,000 cps on a No. 4 spindle at 20 rpm.

The resulting compunds were then foamed to a wet density of 600 g/l. To the foam about 5 $cm^3$ of a 20 percent solution of ammonia/ammonium acetate were added per 100 g of compound. The foamed compound was then applied to the coated surface of the glass fiber substrate in an amount to yield a dry coat weight of about 550 $g/m^2$. The resulting structure was heated under an infrared lamp until gelling occurred and then dried in a circulating hot air laboratory oven at 140° C. for 8 minutes. Samples of the resulting composites which were 5 cm in width were tested for delamination using a model 500 tensometer from Monsanto.

| EXAMPLE (kg/cm width) | DELAMINATION STRENGTH |
|---|---|
| 1 | 0.08 |
| 2 | 0.2 |
| 3 | 0.4 (cohesive failure of foam prior to delamination) |

What is claimed is:

1. A composite material comprising a woven or non-woven glass fiber substrate which is coated with a gelled plastisol of a co- or homo-polymer of vinyl chloride having formed on one surface of said glass substrate and integrally bonded thereto during the process of its formation a foam formed from a compound comprising a latex having a bulk polymer composition comprising
   (a) from about 0 to about 30 percent by weight of a vinyl or vinylidene monoaromatic monomer which may be unsubstituted or substituted by a $C_{1-4}$ aliphatic radical or a bromine or chlorine radical;
   (b) from about 60 to about 85 percent by weight of a $C_{4-6}$ aliphatic conjugated diene monomer; and
   (c) from about 3 to about 40 percent by weight of a polar monomer selected from the group consisting of $C_{2-9}$ ethylenically unsaturated amide, aldehyde, carboxylic acid, and nitrile monomers, and $C_{1-6}$ esters of said carboxylic acid monomers.

2. The composite according to claim 1 characterized in that the latex is a blend of a styrene-butadiene rubber latex with an acrylonitrile-butadiene rubber latex wherein the styrene-butadiene rubber latex has a polymer solids content of about 65 percent by weight and a styrene:butadiene weight ratio of from about 25:75 to about 35:65 and the acrylonitrile-butadiene rubber latex has a polymer solids content of about 56 percent by weight and an acrylonitrile:butadiene weight ratio of from about 30:70 to about 40:60, the weight ratio of the styrene-butadiene rubber latex to the acrylonitrile-butadiene rubber latex being from about 80:20 to about 50:50.

3. The composite according to claim 2 characterized in that the latex blend has a bulk polymer composition comprising (a) from about 15 to about 25 weight percent styrene; (b) from about 65 to about 75 weight percent butadiene; and (c) from about 5 to about 20 weight percent acrylonitrile.

4. The composite according to claim 3 characterized in that the latex blend has a bulk polymer composition comprising (a) about 18 weight percent styrene; (b) about 68 weight percent butadiene; and (c) about 14 weight percent acrylonitrile.

5. A method of manufacturing a composite material comprising a woven or non-woven glass fiber substrate encapsulated with a gelled plastisol of a co- or homopolymer of vinyl chloride coated on at least one surface with a rubber foam which comprises:
   (a) forming a compound comprising a latex having a polymeric content of at least about 60 percent by weight and having a bulk composition
      (i) from about 0 to 30 percent by weight of a vinyl or vinylidene monoaromatic monomer which may be unsubstituted or substituted by a $C_{1-4}$ aliphatic radical or a chlorine or bromine atom;
      (ii) from about 60 to about 85 percent by weight of a $C_{4-6}$ aliphatic conjugated diene monomer;
      (iii) from about 3 to about 40 percent by weight of a polar monomer selected from the group consisting of $C_{2-9}$ ethylenically unsaturated amide, aldehyde, carboxylic acid and nitrile monomers and $C_{1-6}$ esters of said carboxylic acid monomers;
   (b) foaming said compound;
   (c) applying said wet foam compound to at least one surface of glass fiber substrate;
   (d) subjecting said wet foam compound to heating conditions for a time sufficient to set and dry said wet foam.

6. A method according to claim 5 wherein said compound further includes
   (i) up to about 150 parts by weight of a filler per 100 parts by weight of polymeric solids in said latex; and
   (ii) up to about 5 parts by weight of soap or surfactant per 100 parts by weight of polymeric solids in said latex.

7. The method according to claim 6 characterized in that the polar monomer is a $C_{2-9}$ ethylenically unsaturated nitrile monomer.

8. The method according to claim 7 characterized in that the substrate is coated with a polyvinyl chloride plastisol.

9. The method according to claim 8 characterized in that the monoaromatic monomer is styrene, the diene monomer is butadiene, and the nitrile monomer is acrylonitrile.

10. The method according to claim 5 characterized in that the latex is a blend of a styrene-butadiene rubber latex with an acrylonitrile-butadiene rubber latex wherein the styrene-butadiene rubber latex has a polymer solids content of about 65 percent by weight and a styrene:butadiene weight ratio of from about 25:75 to about 35:65 and the acrylonitrile-butadiene rubber latex has a polymer solids content of about 56 percent by weight and an acrylonitrile:butadiene weight ratio of from about 30:70 to about 40:60, the weight ratio of the styrene-butadiene rubber latex to the acrylonitrile-butadiene rubber latex being from about 80:20 to about 50:50.

11. The method according to claim 10 characterized in that the latex blend has a bulk polymer composition comprising (a) from about 15 to about 25 weight percent styrene; (b) from about 65 to about 75 weight percent butadiene; and (c) from about 5 to about 20 weight percent acrylonitrile.

12. The method according to claim 10 characterized in that the latex blend has a bulk polymer composition comprising (a) about 18 weight percent styrene; (b) about 68 weight percent butadiene; and (c) about 14 weight percent acrylonitrile.

13. A method according to claim 10 wherein said compound further includes from about 3 to 7 percent by weight on a wet basis of said latex of a gelling agent.

14. A process according to claim 13 wherein said compound is foamed to a density of from 500 to 800 g/l and is applied at a coat weight of about 500 $g/m^2$.

* * * * *